US005620138A

United States Patent [19]

Crum

[11] Patent Number: 5,620,138

[45] Date of Patent: Apr. 15, 1997

[54] POWDER COATING GUN MOUNTED DIFFUSER AND AIR COOLED HEAT SINK IN COMBINATION WITH LOW FLOW POWDER PUMP IMPROVEMENTS

[75] Inventor: Gerald W. Crum, Elyria, Ohio

[73] Assignee: Nordson Corporation, Westlake, Ohio

[21] Appl. No.: 336,469

[22] Filed: Nov. 9, 1994

[51] Int. Cl.[6] ..... B05B 5/025

[52] U.S. Cl. ..... 239/3; 239/8; 239/704; 239/132.5

[58] Field of Search ..... 239/690, 704, 239/706, 708, 128, 132.5, 3, 8, 13; 361/225–227

[56] References Cited

U.S. PATENT DOCUMENTS

| | | | |
|---|---|---|---|
| 4,284,032 | 8/1981 | Moos et al. | 118/684 |
| 4,462,061 | 7/1984 | Mommsen | 361/227 |
| 4,615,649 | 10/1986 | Sharpless | 406/138 |
| 4,691,865 | 9/1987 | Hoffman et al. | 239/690 |
| 4,979,680 | 12/1990 | Bauch et al. | 239/704 X |
| 4,987,001 | 1/1991 | Knobbe et al. | 427/28 |
| 5,015,126 | 5/1991 | Kramer | 406/152 |
| 5,056,720 | 10/1991 | Crum et al. | 239/698 |
| 5,395,046 | 3/1995 | Knobbe et al. | 239/704 X |

FOREIGN PATENT DOCUMENTS 2276103 9/1994 United Kingdom .

OTHER PUBLICATIONS

Primer on Powder Pumps Date Unknown by Gerald W. Crum, Eng. Mgr. Nordson Cor Pneumatic Handling of Powdered Materials (Including Fluidization).
Published for The Engineering Equipment Users Assoc. by Constable & Company Limited, London, W.C.2, E.E.U.A. Handbook No. 15: 1963.

*Primary Examiner*—Lesley D. Morris
*Attorney, Agent, or Firm*—Howard M. Cohn

[57] ABSTRACT

Apparatus and methods for pumping a uniform flow of air entrained powder at low flow settings to a diffuser of an electrostatic spray gun which disperses the powder and cools the spray gun. A single or double stage pump with a bleed port design draws powder into the pump from a powder container when compressed air directed into the pump is above a predetermined pressure. In another embodiment, a pump delivers a constant velocity of air entrained powder to the spray gun.

12 Claims, 6 Drawing Sheets

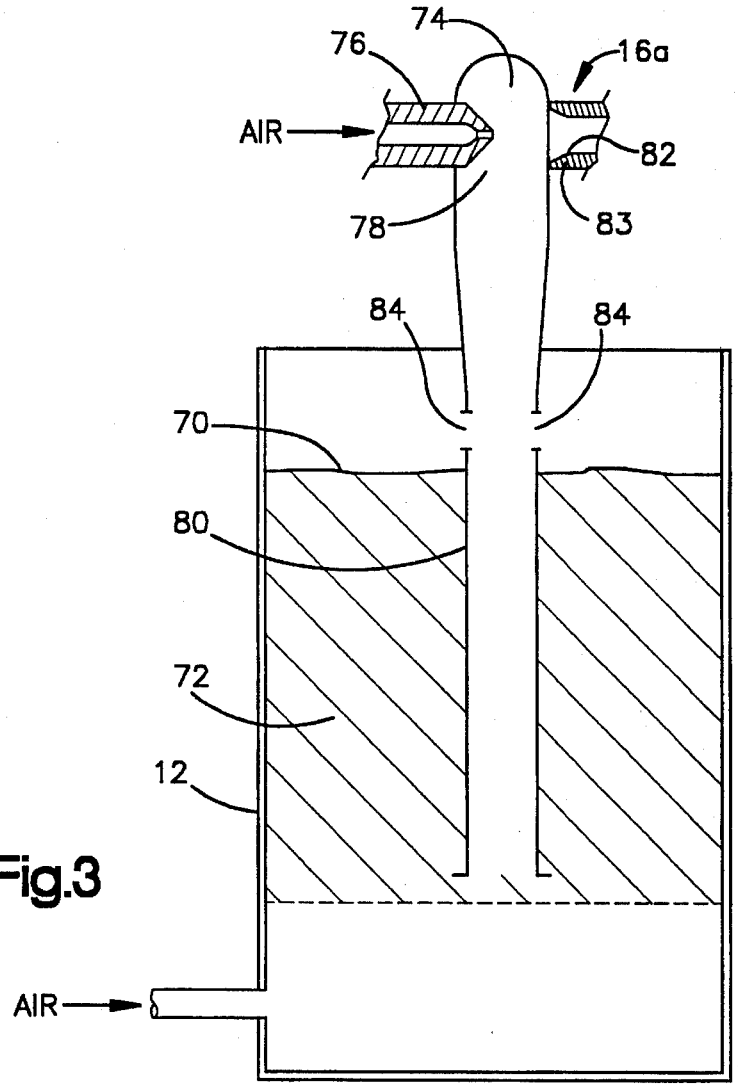
Fig.3
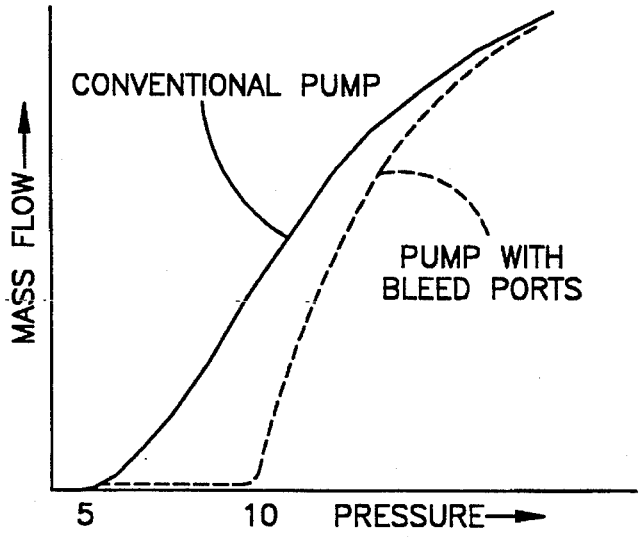
Fig.4 POWDER MASS FLOW VERSUS AIR PRESSURE AT INJECTOR

POWDER COATING GUN MOUNTED DIFFUSER AND AIR COOLED HEAT SINK IN COMBINATION WITH LOW FLOW POWDER PUMP IMPROVEMENTS

FIELD OF THE INVENTION

This invention relates to the field of powder pumps for pumping air entrained powder to powder spray guns which incorporate diffusers for both dispersing the air entrained powder and cooling the spray guns. More particularly, this invention relates to a method and apparatus for pumping a uniform flow of air entrained powder at low flow settings to a diffuser which is secured to a powder spray gun and is capable of both cooling the spray gun housing and dispersing the air entrained powder being delivered to the spray gun.

BACKGROUND OF THE INVENTION

An electrostatic powder spray gun with a high voltage, internal power supply, as illustrated and discussed in U.S. Pat. No. 5,056,720 ('720), assigned to Nordson Corp., the assignee of the present invention, which patent is incorporated by reference in its entirety herein, typically houses a power supply which can include an oscillator and a step-up transformer. Sections of the power supply can be housed either in the body of the gun or externally thereof depending on the specific operating requirements. An important benefit of housing the oscillator within the gun body is that each gun can be factory calibrated to match an external control unit. In the past, when the oscillator was not housed in the gun, each gun required field calibration. However, the oscillator generates heat and when the oscillator is housed within the gun body, means such as passive radiators with natural convection, of the type illustrated in the '720 patent, have effectively dissipated the heat generated in the gun, primarily by the oscillator. Until recently, the cooling requirements for the powder guns was not a significant problem because the powders commonly sprayed were not sensitive to the normal operating temperatures of the powder guns. Recently, however, new powder formulations have been introduced which tend to sinter together in a range of temperatures as low as about 95to about 100 degrees Fahrenheit (F.). Within this temperature range, even the relatively small amount of heat generated by a powder spray gun with an internally housed power supply is excessive. Thus, with the new powder formulations, heat transfer means such as passive radiators with natural convection are inadequate to cool electrostatic guns to a low enough temperature that prevents the sintering problem, particularly if the ambient temperature of the work area is in the range of about 85 to about 90 degrees F.

In powder coating systems, a jet pump or ejector is conventionally used to aspirate powder from a powder container or hopper and to transfer the powder through an outlet conduit to a spray device, i.e., a powder spray gun of the type disclosed in the '720 patent. The ability of a pump or ejector to control the flow rate of the powder is very important in order: a) to deliver the powder smoothly to the spray gun without surging or pulsing effects; b) to control the velocity at which the powder exits the spray gun; c) to insure that the air entrained powder is well dispersed in the air stream when it enters the charging or pattern forming structure in the spray gun; d) to minimize wear of the structural components of the gun; and e) to minimize impact fusion of the powder with the structural components of the spray gun. At present, powder pumping equipment attempts to accomplish these operating requirements with varying tradeoffs and varying degrees of success.

A conventional system for pumping air entrained powder from a container to a spray gun is illustrated in FIGS. 5 and 6, and primarily discussed beginning on column 6 line 47 to column 9, line 54, of U.S. Pat. No. 4,987,001 ('001), assigned to Nordson Corp., the assignee of the present invention, which patent is incorporated by reference in its entirety herein. A primary flow of air directed into pump 114 through an injector nozzle forms an air jet which creates a suction at a powder inlet. The suction at the powder inlet draws fluidized powder from a powder container 100 into pump 114 where it mixes with the air jet. The resulting air entrained powder is propelled through a venturi throat of an outlet pipe 116 to a spray gun. Varying the air flow through the injector nozzle 12 controls the suction and the volume of powder delivered to the spray gun. The air entrained powder can then be directed through an air amplifier 117 which injects a secondary flow of air to increase and precisely control the velocity of the air entrained powder flowing through outlet pipe 116.

While the secondary flow of air can be injected into the system at a location downstream of outlet pipe 116, as shown in the '001 patent, it is also known to inject the secondary flow of air at a location upstream from the powder inlet, see pages 32, 34–37 and 51 of PNEUMATIC HANDLING OF POWDERED MATERIALS, published by Constable & Company Limited, London, England, 1963, and incorporated in its entirety herein.

When the secondary flow of air is injected at an upstream location of the powder pump, the secondary air flow serves to "hold back" the powder and cause more air to be pumped. That is, since both the primary and secondary air flows pass through the venturi throat of outlet pipe 116, the throat velocity of the air entrained powder is higher then when only the primary air flows though the throat. Since impact fusion of powder and general wear of pump components vary in direct proportion to the square of the air velocity, the injection of the secondary air flow upstream from the venturi throat leads to both rapid wear of the pump components and impact fusion of the powder with the pump components.

In either case, i.e., when the secondary air flow is injected at an upstream or a downstream location from the powder pump, after the air entrained powder travels for a distance (usually about 4 to 12 meters) through outlet pipe 116 to the powder gun, the powder separates from the air stream for various reasons, such as the inertial separation effects of the bends in the conduit. To obtain a uniform spray pattern and achieve high electrostatic charging levels, the powder must be redispersed in the air stream before charging or pattern forming occurs. This redispersion can be accomplished by either adding additional air to promote strong turbulence and mixing, or mechanically inducing turbulence.

In some applications, such as when the powder stream is subdivided and distributed through multiple tubes of a triboelectric charging gun of the type described and illustrated in U.S. Pat. No. 4,399,945, which is hereby incorporated by reference in its entirety, the powder must be thoroughly redispersed in the air to insure that the powder is evenly distributed in the flow passage at the point of subdivision. Good results have been obtained with either air jet diffusers, as presently used in a Tribomatic II® gun manufactured by Nordson Corporation of Amherst, Ohio and described in U.S. application Ser. No. 07/956,615, filed Oct. 5, 1992, now U.S. Pat. No. 5,3344,082, which is also hereby incorporated by reference in its entirety, or with porous diffusers as shown in the '001 patent.

A number of serious shortcomings result when a powder spray gun with an air jet diffuser is operated in conjunction with a pump having a secondary air flow injected at either an upstream or downstream location, as previously discussed. First, there is an excess in both the volume and velocity of the air entrained powder being sprayed from the gun which lowers the overall coating efficiency and increases the overspray being generated and the amount of recycled powder introduced into the system. Second, the addition of a diffuser at the pump increases the control devices to three, i.e., one set of controls for each of the primary and secondary air flows at the pump and a third set of controls for the air flow through the diffuser mounted to the gun. Besides the extra cost associated with the additional set of controls, the adjustment of the three sets of controls to obtain the optimum settings is difficult and time consuming, especially for an inexperienced operator. Third, certain types of pattern forming elements and some powder charging schemes are not practical without very good powder dispersion at the gun.

Therefore, there is a need for a practical and easy to use system for pumping air entrained powder at a low flow rate to an electrostatic gun where the powder is redispersed in the air and the gun is cooled so that the new low temperature powder formulations can be effectively sprayed to apply a uniform coating on a workpiece.

OBJECTS AND SUMMARY OF THE INVENTION

It is an object of the present invention to provide a method and apparatus for pumping an air stream with powder to an electrostatic spray gun and dispersing the powder in the air stream while cooling the spray gun to obviate the problems and limitations of the prior art systems.

It is a further object of the present invention to provide method and apparatus for pumping an air stream with powder through a diffuser mounted to a spray gun so that the powder is dispersed in the air stream while the gun is simultaneously being cooled.

Yet another object of the present invention is to provide a method and apparatus for pumping powder to a spray gun with a powder pump whereby the powder is only drawn into the pump from a container of powder after compressed air directed into the pump chamber is above a predetermined pressure.

Still another object of the present invention is to provide a method and apparatus for pumping air entrained powder at a constant velocity to a spray gun.

In accordance with the invention, a spray gun for electrostatically charging coating material emitted from a nozzle thereof comprises a spray gun housing with a heat generating, high voltage power supply mounted therein. A diffuser is mounted to the housing for injecting compressed air into an air stream of powder being conveyed to the nozzle to disperse the powder throughout the air stream and cool the housing from heat generated by the high voltage power supply.

According to the invention, a powder pump for pumping powder to a spray gun comprises a pump chamber having an air inlet connected to a source of compressed air, a powder inlet connected to a source of coating powder, and a powder outlet connected to a delivery conduit for directing air entrained powder to the spray gun. A pickup tube has one end adapted for insertion into a container of the powder and an opposite end connected to the powder inlet of the pump chamber. The pickup tube has at least one bleed port located between the powder level of the powder stored within the container and the pump chamber. The bleed port enables the air surrounding the pickup tube to be drawn into the pump chamber through the bleed port in response to compressed air flow through the air inlet below a predetermined pressure whereby the powder is prevented from being drawn through the pickup tube into the pump chamber until the compressed air being directed into the pump chamber is above the predetermined pressure.

According to the invention, the delivery conduit has a venturi throat located adjacent and directly downstream from the powder outlet of the primary pump chamber for controlling the velocity of the air entrained powder being pumped to the spray gun. A secondary air inlet injects compressed air into the air stream containing powder flowing through the delivery conduit at a location downstream from the venturi throat to prevent the powder from settling out of the air stream prior to reaching the spray gun.

Further in accordance with the invention, a constant volume conveying system for pumping coating powder to a spray gun includes an expansion nozzle for delivering a constant volume of air into a cylindrical outlet tube. The expansion nozzle is connected at one end to a source of compressed air and at the opposite end to the cylindrical outlet tube. A powder inlet in the cylindrical outlet tube directs coating powder from a pickup tube having an inlet end inserted into a container of coating powder and an outlet end connected to the powder inlet to the cylindrical outlet tube in response to the air stream flow through the expansion tube. A flow inducer is disposed beneath the surface of the powder to blow the powder up the pickup tube and into the constant volume air stream flowing through the cylindrical outlet tube whereby air entrained powder at a constant velocity is pumped to the gun.

BRIEF DESCRIPTION OF THE DRAWINGS

The structure, operation, and advantages of the presently preferred embodiment of the invention will become further apparent upon consideration of the following description taken in conjunction with the accompanying drawings, wherein:

FIG. 3 is a side elevational schematic view, partially in cross section, of a single stage pump with a bleed port design suitable for incorporation into the system shown in FIG. 1;

FIG. 4 shows a plot of the operating characteristics of the pump shown in FIG. 3;

DETAILED DESCRIPTION OF THE INVENTION

Figure 1:
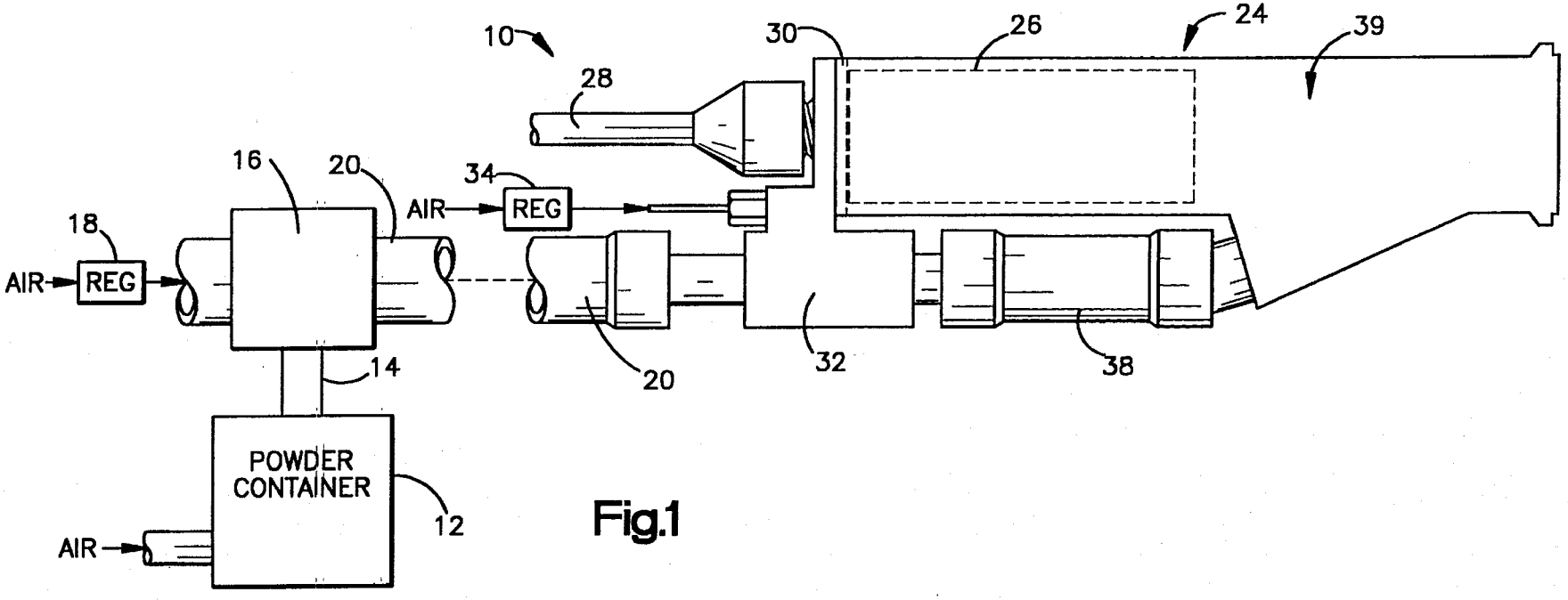
FIG. 1 is a side, elevational schematic illustration of a system for pumping air entrained powder to an electrostatic spray gun, constructed according to the principles of the present invention.

With reference to FIG. 1, there is illustrated schematically a system 10 for spraying solid particulate, coating powder onto the surface of an article or workpiece (not shown). The system 10 includes a fluidized bed, powder container or hopper 12 which is constructed in accordance with the principles set forth in the '001 patent. Fluidized powder is drawn upward through conduit 14 into a venturi pump 16. Pressured air from a source of air (not shown) flows through an air regulator 18 and into pump 16. The regulated air suctions the powder into pump 16 from conduit 14 and directs a stream of air entrained powder through a delivery conduit 20, typically a flexible hose, to a powder spray gun 24 configured to operate with an internal power supply 26, such as a voltage multiplication circuit, connected by an electrical cable 28 to an external low voltage source (not shown). The voltage multiplication circuit 26 abuts against a heat sink plate 30 which in turn abuts against a thermally conductive diffuser 32. The stream of air entrained powder from pump 16 flows through diffuser 32 where air, supplied from a source of pressured air through a pressure regulator 34, mixes with the stream of air entrained powder to disperse the powder and direct the stream of air entrained powder through a conduit 38 to the spray nozzle section 39 of gun 24 from which the air entrained powder is electrostatically charged and sprayed towards the article being coated.

Figure 2:
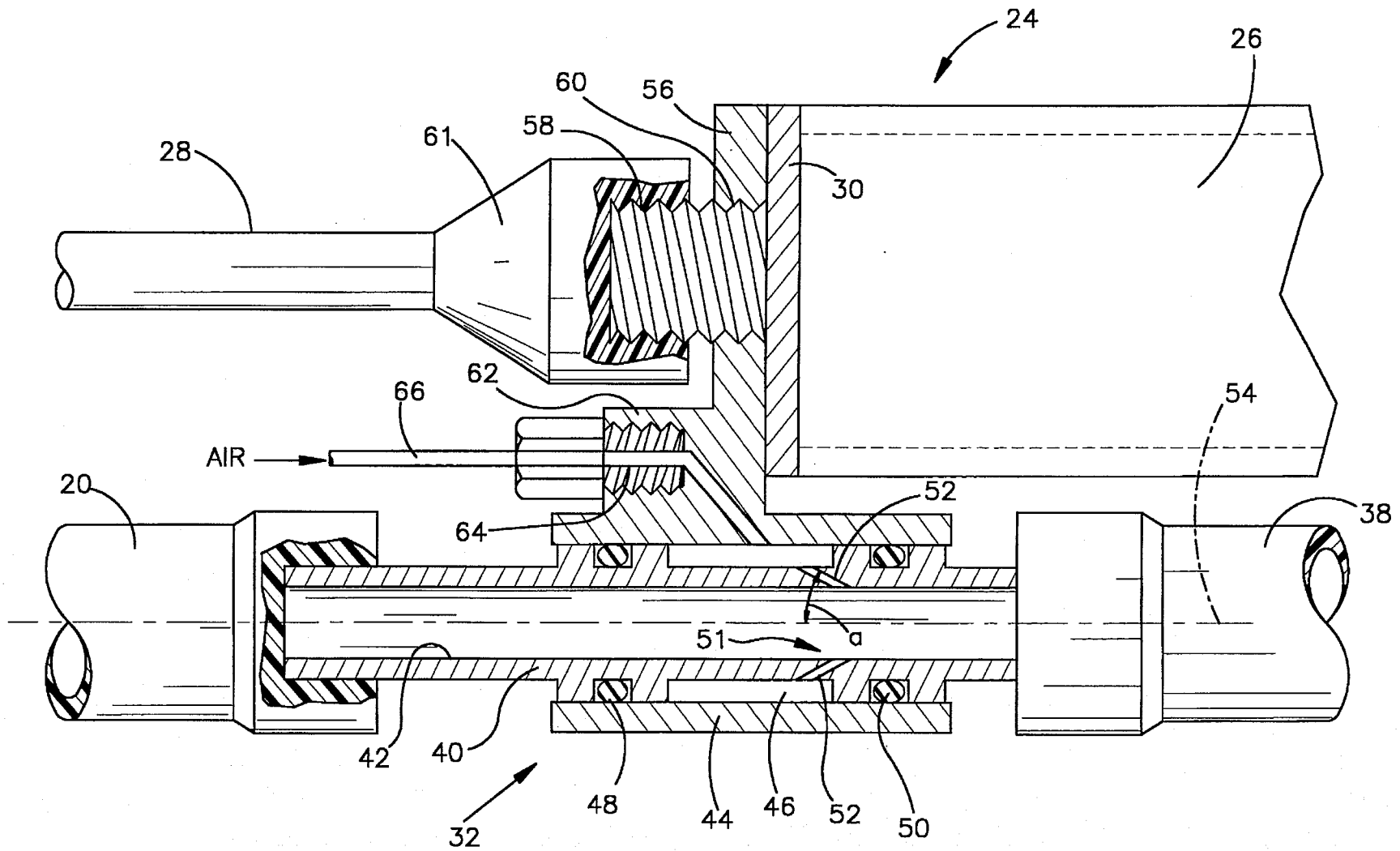
FIG. 2 is an enlarged side elevational view, partly in cross section, of a diffuser mounted to the rear end of the electrostatic spray gun shown in FIG. 1.

Referring to FIG. 2, the features and construction of the thermally conductive diffuser 32 are described. Diffuser 32 is constructed of an elongated, inner cylindrical body 40 with a through-bore 42 therethrough which is connected at one end to the spray nozzle section 39 (shown in FIG. 1) by a conduit 38, typically a flexible hose, and at the other end to pump 16 by delivery conduit 20. An outer elongated cylindrical body 44 is disposed in concentric relation about inner body 40 to form an air chamber 46 which can be sealed at opposite ends with o-rings 48 and 50. A passage 51 interconnects chamber 46 with through-bore 42. The passage can be formed of a plurality of evenly distributed ports 52 each of which is inclined in the direction of air entrained powder flow through bore 42 of diffuser 32. Ports 52 are disposed at an angle "a" which is preferably between about 7 and about 60 degrees and more preferably between about 15 and about 30 degrees with respect to a center line 54 extending longitudinally through diffuser 32. As discussed herein, injecting air through ports 52 into the stream of air entrained powder, in the direction of powder flow, serves to both redistribute the powder in the flow and increase the pumping action of the flow to offset losses in conduit 20 and spray gun 24.

Figure 2A:
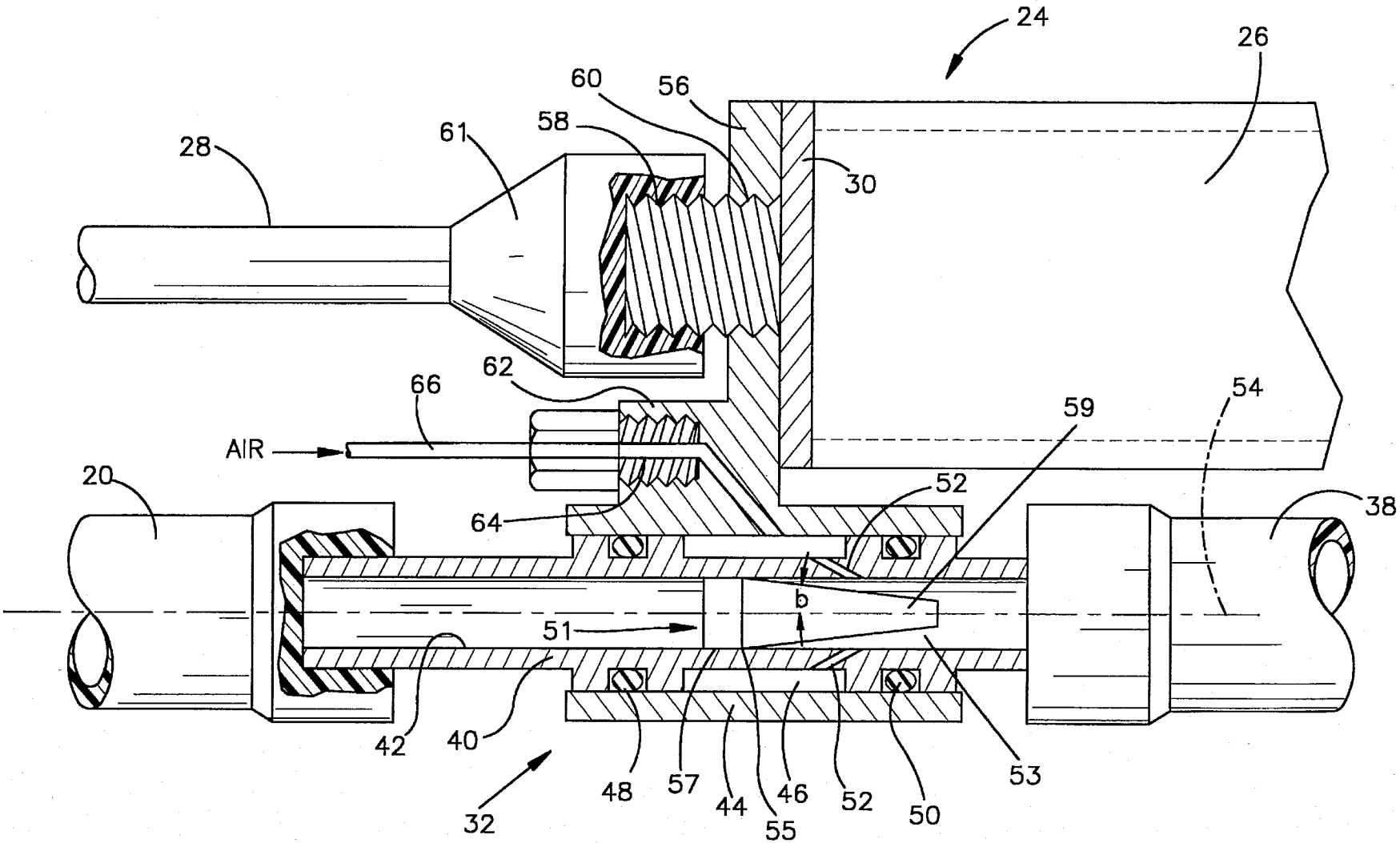
FIG. 2A is an enlarged side elevational view, partly in cross section, of a second embodiment of a diffuser mounted to the spray gun shown in FIG. 1.

It is also within the terms of the invention, as shown in FIG. 2A, to form passage 51' with an annular passageway 53 which is inclined in the direction of air entrained powder flow through bore 42 of diffuser 32. An elongated annular tube 55 is secured at the upstream end 57 against the surface of bore 42, such as by being integrally formed with the annular tube or by a frictional fit. The diameter of tube 57 is smaller at the downstream end 59 to form annular passageway 53 between the outer surface of tube 55 and bore 42. A plurality of ports 52 connect chamber 46 with passageway 53. Annular passageway 53 is disposed at an angle "b" which is preferably between about 0 degrees and about 60 degrees and more preferably between about 0 degrees and about 30 degrees with respect to a center line 54 extending longitudinally through diffuser 32. Annular passageway 53 directs an annular ring of compressed air into the stream of air entrained powder, in the direction of powder flow to both redistribute the powder and provide additional pumping action in the flow to offset flow losses in the conduit 20 and the spray gun 24.

Diffuser 32 includes a thermally conductive support bracket 56 which is preferably shaped to cover the rear surface of gun 24 and preferably abuts against a heat sink plate 30 which in turn abuts against high voltage multiplier circuit 26. Support bracket 56 is constructed from a thermally conductive material, such as aluminum, to assist in heat dissipation from gun 24, as discussed below. A threaded insert 58 is secured to gun 24 and projects outward from a threaded hole 60 through support bracket 56. A nut (not shown) can be threaded onto insert 58 to secure support bracket 56 against heat sink plate 30. Electrical cable 28, which is secured to the threaded insert 58 by a cable nut 61, delivers low voltage power to high voltage multiplier circuit 26. Support bracket 56 also includes a compressed air inlet section 62 having an inlet passage 64 that is connected by a conduit 66 to an air regulator 34 (shown in FIG. 1) and a source of pressurized air (not shown). Inlet passage 64 is connected to air chamber 46 so that pressurized air can be supplied from adjustable pressure regulator 34 into inlet passage 64 and air chamber 46. The pressurized air is then directed radially through passage 51 into the flow of air entrained powder in through-bore 42.

A principle feature of this invention is the use of active cooling of heat sink plate 30. Besides the performance benefits resulting from dispersing the air entrained powder with diffuser 32, diffuser support bracket 56 also serves as a heat exchanger to conduct heat away from heat sink plate 30 by compressed air, forced convection cooling through air inlet section 62 of diffuser 32. The compressed air is channeled through diffuser support bracket 56, made of a thermally conductive material such as aluminum, to annular chamber 46 where the compressed air is uniformly dispersed at a relatively high velocity between the inner and outer cylindrical bodies 40 and 44, respectively. Since the compressed air flows over a large surface area of the aluminum support bracket 56, a significant amount of heat is capable of being transferred from heat sink plate 30 into the stream of compressed air. By adding the aluminum support bracket 56 to the rear of spray gun 24, the external surface area of the gun is effectively increased which further cools the gun by means of heat convection away from the gun body.

In terms of the present invention where low operating temperatures are needed to spray the new, low temperature powder formulations, cooling with compressed air has an important advantage over natural convection which was relied on in the past because the temperature of the compressed air is typically lower than the ambient room temperature. Thus, heat sink plate 30 can now be cooled to a temperature equal to or below ambient room temperature. A powder gun which uses a support bracket 56 with compressed air cooling can thereby reach a lower operating temperature than a comparable gun with the oscillator section, e.g., the major heat producing section of the high voltage power supply, external to the gun since the other sections of the power supply, e.g., the voltage multiplier and the high voltage transformer, still generate enough heat to adversely effect the spraying of the new, low temperature powder formulations. Also, owing to the velocity of the compressed cooling air through heat sink plate 30, there is much less thermal resistance at the solid-to-air interface and heat is transferred more effectively. This resistance is Conventionally known as the "film heat transfer coefficient".

Another principle feature of the invention relates to a pump 16, as shown in FIG. 1, which is capable of pumping a uniform flow of air entrained, solid particulate powder at low flow settings. One embodiment of the invention is directed to the construction of a suitable pump which is illustrated and identified in FIG. 3 as pump 16*a*. Pump 16*a* is a top mounted, powder pump which includes a novel "bleed port" design and is configured for a maximum powder flow rate of approximately 60 pounds per hour. Pump 16*a* is mounted above the powder level 70 of a conventional container or hopper 12 of fluidized powder 72 so that air directed into the pump chamber 74 through an injector nozzle 76 creates a suction at a powder inlet 78 and draws fluidized powder 72 from powder container 12 into pump chamber 74 through a pickup tube 80. The now air entrained powder in pump chamber 74 is propelled through a venturi throat 82 of outlet 83 and into conduit 20, as shown in FIG. 1. One or more bleed ports 84 extend through the wall of pickup tube 80. While bleed ports 84 are preferably located in pickup tube 80 at a position above the top of powder level 70, it is also within the terms of the invention to provide bleed ports in another location such as directly through the pump casing into pump chamber 74.

In operation, pump 16*a* is controlled by air regulator 18, as shown in FIG. 1, through gradually increasing the flow of compressed air from a no flow condition to a flow at a predetermined pressure whereby the compressed air is directed through injector nozzle 76 and into pump chamber 74. Initially, the powder will not be drawn up tube 80 because the suction generated in pump chamber 74 by the compressed air will only be adequate to draw in ambient air through bleed ports or holes 84 of pickup tube 80. After the compressed air flow through injector 76 is sufficiently increased, pumping capacity in pump chamber 74 will increase and draw enough air through bleed ports 84 to create a significant flow restriction in ports 84. This flow restriction, in turn, will generate sufficient suction in pump chamber 74 to aspirate powder up tube 80 into pump inlet 78.

During the development of the present invention, a comparative test of the operation of a powder pump equipped with a pickup tube having bleed ports and the operation of an identical powder pump equipped with a conventional pickup tube without bleed ports was conducted. As shown in FIG. 4, a plot of powder mass flow versus injector air pressure, when the pump is conventionally equipped with a pickup tube without bleed ports, the mass powder flow is initiated when the air pressure at the injector nozzle reaches a value of approximately 4–5 pounds per square inch (psi). Even then, when the pump does begin to operate, the velocity of the air entrained powder is insufficient to keep the powder in suspension until it reaches the spray gun. Instead, the powder begins to settle out of the air entrained powder flow and builds up in the delivery conduit and/or form slugs of powder. Moreover, the powder which reaches the gun is not uniformly dispersed in the stream of air entrained powder and if sprayed forms an uneven coating.

By contrast, with the improved pickup tube 80 of the present invention, i.e. having a single bleed port 84 with a diameter of 0.19" (or two bleed ports each with a diameter of 0.13"), used in conjunction with a standard Nordson pump, such as a Model 100 Plus® P/N 245100, the powder mass flow is not initiated until the compressed air pressure at injector nozzle 76 reaches a value of between approximately 10 to 12 psi. At this higher pressure, even at the onset of powder flow, there is a large volume of air being drawn in through bleed ports 84 to mix with the powder being drawn into the pump through pickup tube 80 so that the velocity of the air-entrained powder in conduit 20 is high enough to insure that the powder remains in suspension at least until it reaches the gun. None the less, the velocity of the air entrained powder is still kept as low as possible, while ensuring that the air entrained powder reaches the gun, to prevent parts wear and impact fusion of the powder on the component parts of both pump 16 and gun 24. Operating pump 16, so that the velocity of the air entrained powder is held at a minimal value, is most feasible when pump 16 is used in conjunction with a diffuser, such as diffuser 32, at gun 24 to redisperse the powder prior to electrostatically charging and spraying.

Another important effect of incorporating bleed holes 84 in pickup tube 80 is the smooth transition from no flow to minimal flow of the air entrained powder to gun 24. That is, when gun 24 is triggered on, the air entrained powder starts flowing without any surging or puffing. Then, when the powder gun is triggered off, the flow of air entrained powder cuts off sharply. While these features relating to the flow during start up and shut down of the pump are important in spraying a uniform coating, they could not be achieved with the prior art pump designs. These advantages were unknown before the incorporation of bleed holes in the pickup tube. Prior to this invention, the use of bleed holes in a pickup tube was thought to be undesirable since they reduce the efficiency of the pump by breaking the suction on the fluidized powder in the powder container at low pump settings. At higher pump settings, even with the present invention, the bleed ports don't effect the operation of the pump since they are effectively restricted while the pump is delivering the air entrained powder at a typical velocity of at least about 1200 feet per minute.

Figure 5:
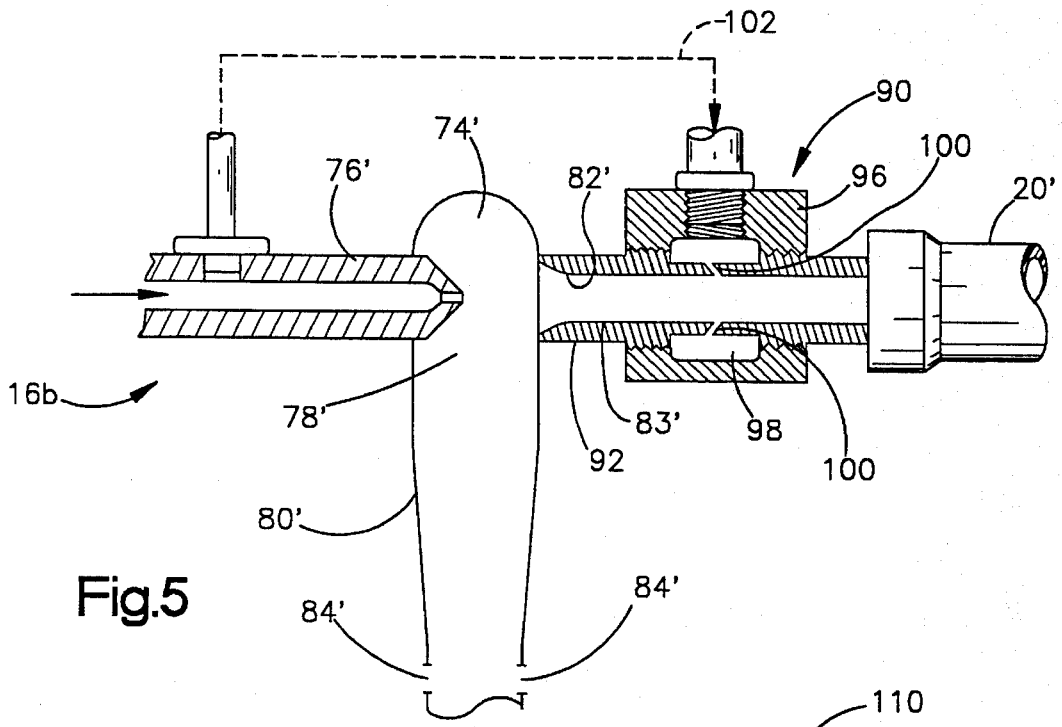
FIG. 5 is a side elevational view, partly in cross section, of a two-stage pump incorporating a bleed port design which is an alternative embodiment that is suitable for incorporation into the system shown in FIG. 1.

FIG. 5 shows a two stage pump 16*b* which can be substituted for pump 16 in the system illustrated in FIG. 1. Pump 16*b* is similar to pump 16*a* but has an additional second stage 90. While pump 16*b* resembles a conventional two stage pump with secondary air introduced downstream, as shown in the '001 patent, it differs from the prior art in that a) both the first stage injector 76' and the second stage 90 are supplied from a single source of pressurized air which can be regulated by air regulator 18; and b) the second stage 90 is sized to provide optimal pumping without further dispersion of the air entrained powder. Throughout the specification, primed and double primed numbers represent structural elements which are substantially identical to structural elements represented by the same unprimed number. An important advantage of two stage pump 16*b*, as compared with single stage pump 16*a*, is that the flow of air entrained powder in two stage pump 16*b* is less sensitive to the length of the conduit 20' connecting pump 16*b* to gun 24 or to changes in downstream conditions, such as replacing the gun nozzle with one of a different size or configuration.

As with single stage pump 16*a* discussed hereinbefore, two stage pump 16*b* pumps a uniform flow of air entrained coating powder to a coating gun 24 at low flow settings. Like pump 16*a*, pump 16*b* is adapted to be mounted above the powder level 70 of a conventional hopper 12 of fluidized powder and includes the novel "bleed port" design. Air directed into pump chamber 74' through an injector nozzle 76' creates a suction at powder inlet 78' and draws fluidized powder into pump chamber 74' through a pickup tube 80' having one or more bleed ports 84'. It is also within the terms of the invention to provide the bleed ports in another location such as in the wall forming pump chamber 74'. The air entrained powder in pump chamber 74' is propelled across a venturi throat 82', into a through-bore 83' of connector conduit 92, through second stage 90, and to gun 24 through conduit 20'.

The second stage 90 is constructed of a housing 96 forming an air chamber 98 concentrically arranged about through-bore 83' of connector conduit 92. A plurality of evenly spaced jet inlets 100 are formed through the wall of connector conduit 92 and are preferably disposed at an angle of between about 7 to about 45 degrees so that the air flowing from conduit 102, connected to the inlet conduit at a location downstream of air regulator 18, is injected into air entrained powder flowing in through-bore 83' to increase the pumping action and prevent the settling out of the powder from the flow of air entrained powder in outlet conduit 20' before reaching the diffuser 32 attached to gun 24.

Figure 6:
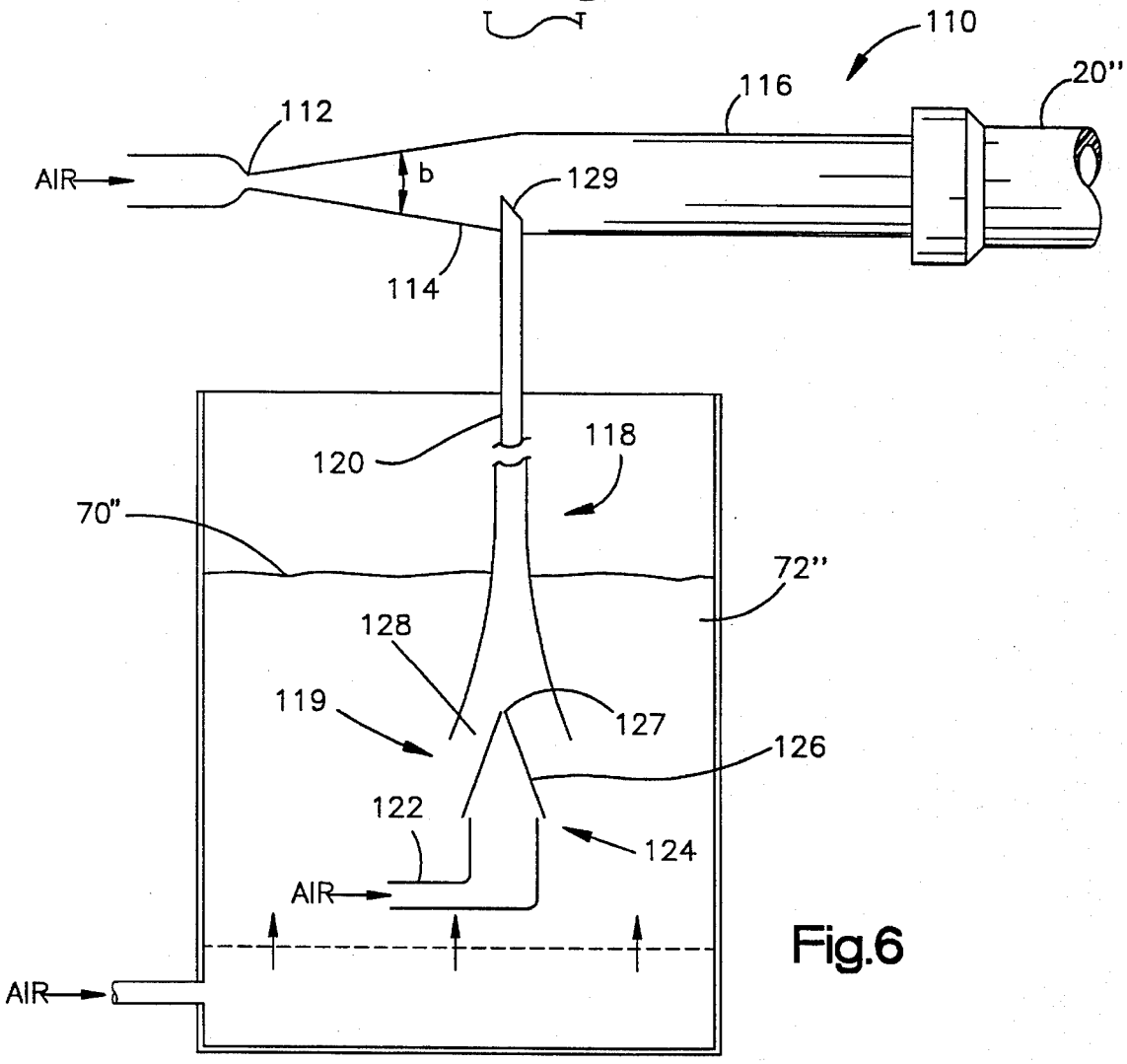
FIG. 6 is a side, elevational schematic illustration of an alternative embodiment of the pumping portion of the system shown in FIG. 1 which includes a constant volume pumping system.

While the single and two stage pumps **16*a* and 16*b*, respectively, can effectively transfer powder, usually air entrained powder, from a hopper to a spray gun, another embodiment of a conveying system, as illustrated in FIG. 6, provides a soft, controllable, powder spray pattern with a constant volume conveying system 110. In this embodiment, a flow of compressed air through an orifice 112 creates an air let in an expansion nozzle 114 having an approximate included angle "b" of between about 15 to about 19 degrees and preferably about 17 degrees. The included angle is selected to prevent flow separation and turbulence in the air entrained powder flow through cylindrical outlet tube 116. That is, the air jet is expanded in nozzle 114 to provide a smooth, conveying air flow into which a very "rich" powder/air mixture (high ratio of powder to air) is injected by a powder injection tube 118. The rich mixture only requires a small volume of conveying air to be mixed in with the powder to maintain a relatively constant air volume in conduit 20". The air flow into orifice 112** is from a constant air supply, rather than the adjustable air supply used with the single and two stage pumps described before.

In an exemplary operation of constant volume conveying system 110, the conveying air flows through an orifice 112 having a diameter of about 0.060 inches. For a conduit 20" having a 0.50 inch inside diameter, an air volume of about 2 cubic feet per minute (cfm) causes the air entrained powder to have a velocity which is close to optimum velocity, i.e., about 1500 feet per minute.

To reach this velocity, about 50 psi is needed on the upstream side of orifice 112. Since the backpressure in conduit 20" is typically less than 1 psi, the pressure drop across orifice 112 is the primary factor in controlling the flow rate of the air through orifice 112. Thus, a constant pressure drop results in an air flow having a substantially constant volume and velocity irrespective of the volume of powder flow or the length of conduit 20".

Two important considerations in the operation of constant volume conveying system 110 are: a) selecting the pressure drop across orifice 112 so that the volume of air is sufficient to keep the powder in suspension in conduit 20"; and b) injecting of the fluidized coating powder into the constant volume of air flowing through tube 116 with the minimum accompanying volume of air so as to maintain the volume of air entrained powder flowing through conduit 20" as nearly constant as possible.

The powder can be injected into the flow of air entrained powder in one of several ways. In one system commonly called a "powder fountain", as illustrated in FIG. 6, a flow inducer 118 provides a rich mixture to minimize air volume. The inlet section 119 of flow inducer 118 is located beneath the surface 70" of powder 72" and acts to lift the powder up the injection tube 120 and to blow it gently into the constant volume air stream flowing through tube 116. By using an air regulator or valve (not shown), the volume of powder being conveyed to a gun through conduit 20" can be controlled by adjusting the pressure of the air through air inlet 122 into an injector nozzle 124 of flow inducer 118. Since flow inducer 118 uses only small amounts of air, the velocity of the air entrained powder flowing through tube 120 is low and wear and impact fusion are negligible. Further, the velocity of the air entrained powder flowing through powder conduit 20" is held at a constant, optimum value which minimizes wear and impact fusion on pump and gun component parts, as compared with prior art pumping systems. Several alternative flow inducers, adapted to provide a rich mixture with a minimum air volume, are now described.

As illustrated in FIG. 6, a nozzle 126 having an air inlet 122 is positioned to direct air through an outlet opening 127 and into the flared inlet 128 of tube 120. This flow of air draws fluidized powder 72" into the inlet 128 of tube 120 and injects the mixture of powder and air flowing from the outlet 129 of tube 120 into the air flow from diffuser tube 114. As discussed before, an important requirement of system 110 is to minimize the volume of air needed to carry the powder from hopper 72" to outlet tube 116. Therefore, the air flow through inlet 122 is kept at the minimum value which is still adequate to deliver a "rich" powder/air mixture into the air flowing into through tube 116.

Figure 7:
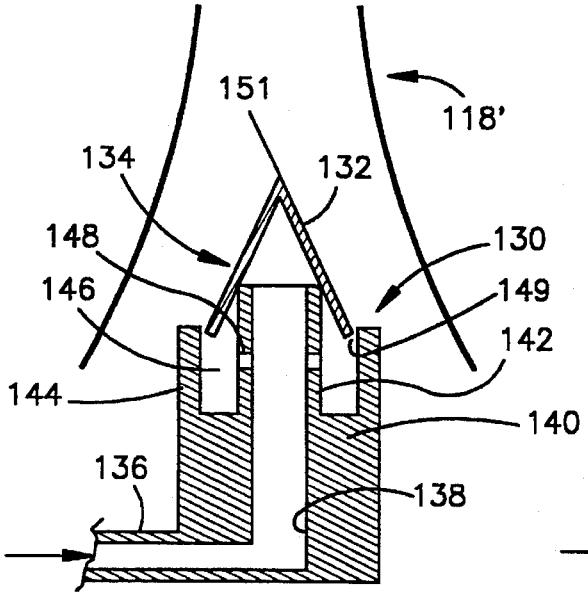
FIG. 7 is an elevational enlarged view, partly in cross section, of a first embodiment of the nozzle section of a flow inducer used in the system shown in FIG. 6.

Referring to FIG. 7, there is illustrated an alternative embodiment of a flow inducer 118' which incorporates a nozzle 130 that can be substituted for nozzle 124 shown in FIG. 6. Nozzle 130 is designed to create a thin sheet of air flow across the surface 132 of a cone shaped, end section 134. Nozzle 130 has an air inlet 136 connected to an internal passage 138 through a cylindrical, hollow body section 140. An inner cylindrical wall 142 extends upward from body section 140 and has cone shaped end section 134 secured thereto by conventional means, such as brazing. An outer cylindrical wall 144 extends upward from body section 140 and is disposed in coaxial relationship with inner cylindrical wall 142 to form an annular cavity 146. A plurality of openings 148 through inner cylindrical wall 142 direct air flowing from inlet 136 and internal passage 138 into annular cavity 146. The outer cylindrical wall 144 extends upward to a location which slightly overlaps the base of cone shaped end section 134 to form an annular opening 149. The air flow through annular opening 149 creates a thin conical sheet of air over the surface 132 of cone shaped end section 134. The conical sheet of air intersects at a point beyond the tip 151 of the end section 134. The cone shaped end section 134 of nozzle 130 is required to support and stabilize the thin sheet of air. One advantage of nozzle 130 is that the compressed air from inlet 136 is spread out over a large surface area to quickly and efficiently transfer the momentum of the air into the surrounding fluidized powder for delivery of the powder through flow inducer 118' into tube 116. This design is particularly effective because it takes advantage of the nature of a jet of compressed air which primarily transfers momentum on its outside surface.

Figure 8:
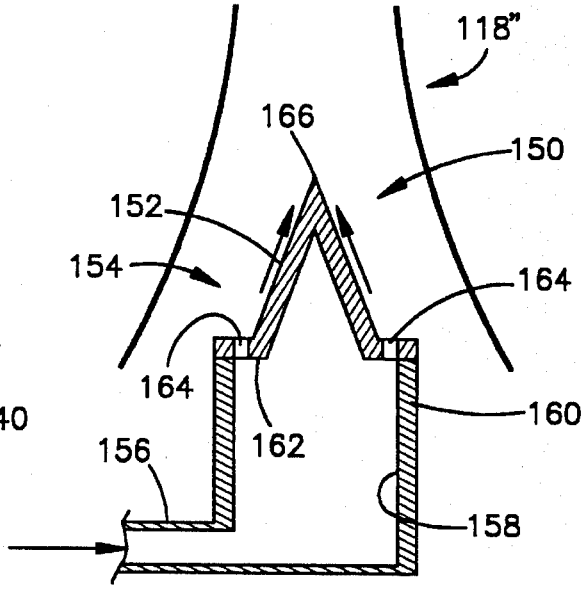
FIG. 8 is an elevational, enlarged view, partly in cross section, of a second embodiment of the nozzle section of a flow inducer used in the system shown in FIG. 6.

Referring to FIG. 8, there is illustrated a nozzle 150 which is an alternative embodiment to nozzles 119 and 130, illustrated in FIGS. 6 and 7, respectively. As with nozzle 130, nozzle 150 is designed to form a thin sheet of air flowing over the surface 152 of a cone shaped end section 154. Nozzle 150 has an air inlet 156 connected to an internal passage 158 through a hollow, cylindrical body section 160. The base 162 of cone shaped, end section 154 can be secured to the upper end of body section 160 by any conventional means such as welding or brazing. A ring of evenly spaced discrete orifices 164 through base 162 of cone shaped, end section 154 directs jets of air flowing from inlet 156 and through internal passage 158 over the surface 152 of cone shaped, end section 154 to form a thin sheet of air which intersects at a point beyond the tip 166 of conical end section 154. The advantage of this embodiment is similar to that of the embodiment illustrated in FIG. 7, in that the compressed air is split up into a number of jets which have a larger surface area then a single jet of equal cross sectional area. Further, the air spreads out to form a large surface area so that the momentum of the compressed air flow is quickly and efficiently transferred into the surrounding fluidized powder for delivering the powder through flow inducer 118" into tube 116.

It is apparent that there has been provided in accordance with this invention apparatus and methods for pumping a stream of powder to an electrostatic spray gun and dispersing the powder in the air stream while cooling the spray gun that satisfy the objects, means and advantages set forth hereinbefore. According to the invention, a diffuser mounted to an electrostatic spray gun directs a flow of compressed air into the stream of powder being pumped to the gun so that the powder is dispersed in the stream and the gun is simultaneously cooled. Single and double stage powder pumps include novel bleed port designs so that powder is not drawn into the pump chamber from a container of powder until compressed air directed into the pump chamber is above a predetermined pressure. The invention also discloses a pump for pumping air entrained powder at a constant velocity to the spray gun.

While the invention has been described in combination with embodiments thereof, it is evident that many alternatives, modifications, and variations will be apparent to those skilled in the art in light of the foregoing teachings. Accordingly, the invention is intended to embrace all such alternatives, modifications and variations as fall within the spirit and scope of the appended claims.

We claim:

1. The method of delivering a stream of air entrained charging powder to a spray gun comprising the steps of:

providing a spray gun with a nozzle section, a high voltage power supply, a heat sink plate abutted against said high voltage power supply, and a diffuser mounted to said heat sink plate and connected to said nozzle section by a conduit;

directing a stream of air entrained powder through said diffuser and through said conduit to said nozzle section of said spray gun;

directing compressed air through said heat sink plate and into said stream of air entrained powder in said diffuser to redistribute said air entrained powder in said stream of air entrained powder being directed through said diffuser and to direct said stream of redistributed air entrained powder into said conduit and to said nozzle section while transferring heat generated by said high voltage power supply from said heat sink plate to said compressed air.

2. The method of claim 1 including the step of directing an annular ring of said compressed air into said stream of air entrained powder in said diffuser to disperse said air entrained powder and to cool said spray gun.

3. A spray gun for electrostatically charging powder emitted from a nozzle section thereof, comprising:

a spray gun housing;

a high voltage power supply which generates heat mounted within said gun housing;

a thermally conductive support bracket mounted to said high voltage power supply, said support bracket having a support bracket air passage connected to a source of compressed air therethrough; and a diffuser mounted to said support bracket, said diffuser having a diffuser air passage in communication with said support bracket air passage for injecting compressed air into a stream of air entrained powder flowing to a nozzle section and for cooling said gun housing.

4. The spray gun of claim 3 wherein said diffuser includes a diffuser body having said diffuser air passage therethrough for directing said compressed air from an inlet section of said diffuser body into said stream of air entrained powder.

5. The spray gun of claim 4 wherein said diffuser air passage includes a plurality of ports through which said compressed air is injected into said stream of air entrained powder as a plurality of air jets to disperse said air entrained powder within said stream of air entrained powder and cool said spray gun from heat generated by said high voltage power supply.

6. The spray gun of claim 5 wherein said plurality of ports are equally spaced about said throughbore and form an angle of about 7 degrees to about 60 degrees with a centerline extending longitudinally through said throughbore.

7. The spray gun of claim 4 wherein said diffuser air passage includes an annular passageway through which an annular ring of said compressed air is injected into said stream of air entrained powder to disperse said air entrained powder within said stream and cool said spray gun from heat generated by said high voltage power supply.

8. The spray gun of claim 4 wherein said diffuser body includes:

an elongated inner cylindrical body member with a throughbore carrying said stream of air entrained powder, said inner cylindrical body member connected at one end to said nozzle section and at an opposite end to a source of said air entrained powder;

an elongated outer cylindrical body member disposed about said elongated inner cylindrical body member and spaced therefrom to form an enclosed air chamber between said inner and outer elongated body members, said enclosed chamber being connected by said diffuser air passage to said throughbore for directing said compressed air flowing through said diffuser air passage into said stream of air entrained powder flowing through said throughbore.

9. The spray gun of claim 8 wherein said diffuser air passage includes an annular passageway through which an annular ring of said compressed air is injected into said stream of air entrained powder to disperse said air entrained powder within said stream and to cool said housing from heat generated by said high voltage supply.

10. The spray gun of claim 9 further including an annular tube disposed in said throughbore of said inner cylindrical body member and having an outer surface spaced from the surface of said throughbore to form said annular passageway.

11. The spray gun of claim 9 wherein said annular passageway forms an angle of about 0 degrees to about 60 degrees with a centerline extending longitudinally through said throughbore.

12. The spray gun of claim 8 wherein:

said thermally conductive support bracket is abutted against a heat sink plate which is in contact with said high voltage power supply; and said inlet section of said diffuser body is located within said support bracket for directing said compressed air through said support bracket and into said enclosed air chamber whereby said compressed air can flow through said diffuser air passage and into said throughbore to cool said housing by transferring heat generated by said high voltage power supply from said heat sink plate into said support bracket and then into air surrounding said diffuser body as well as into said stream of air entrained powder.

* * * * *